US011394120B2

(12) United States Patent
Zhang et al.

(10) Patent No.: US 11,394,120 B2
(45) Date of Patent: Jul. 19, 2022

(54) MILLIMETER WAVE FILTERING ANTENNA AND WIRELESS COMMUNICATION DEVICE

(71) Applicant: SOUTH CHINA UNIVERSITY OF TECHNOLOGY, Guangzhou (CN)

(72) Inventors: Xiuyin Zhang, Guangzhou (CN); Shengjie Yang, Guangzhou (CN); Yihui Yao, Guangzhou (CN); Yunfei Cao, Guangzhou (CN); Quan Xue, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 58 days.

(21) Appl. No.: 16/996,016

(22) Filed: Aug. 18, 2020

(65) Prior Publication Data

US 2021/0057823 A1 Feb. 25, 2021

(30) Foreign Application Priority Data

Aug. 19, 2019 (CN) ..... 201910762377.3

(51) Int. Cl.
*H01Q 9/04* (2006.01)
*H01Q 1/36* (2006.01)

(52) U.S. Cl.
CPC ..... *H01Q 9/0414* (2013.01); *H01Q 1/36* (2013.01)

(58) Field of Classification Search
CPC .. H01Q 1/36; H01Q 1/38; H01Q 9/04; H01Q 9/0407; H01Q 9/0414; H01Q 9/0435; H01Q 9/045; H01Q 9/0478; H01Q 9/16; H01Q 13/106
See application file for complete search history.

(56) References Cited

U.S. PATENT DOCUMENTS

| | | | | |
|---|---|---|---|---|
| 7,911,386 | B1 * | 3/2011 | Itoh | H01Q 9/0407 343/700 MS |
| 2015/0214634 | A1 * | 7/2015 | Lee | H01Q 9/065 343/797 |
| 2018/0097293 | A1 * | 4/2018 | Piegsa | H01Q 5/392 |
| 2019/0103676 | A1 * | 4/2019 | Sugimoto | H01Q 7/00 |

* cited by examiner

*Primary Examiner* — Thai Pham
(74) *Attorney, Agent, or Firm* — Kagan Binder, PLLC

(57) ABSTRACT

A millimeter wave filtering antenna and a wireless communication device are disclosed. The millimeter wave filtering antenna includes a parasitic unit, a feeding unit and a feeding network. The parasitic unit includes at least one quadrilateral parasitic patch and at least one cross shaped parasitic patch, both of which are nested and combined with each other. The feeding unit includes a feeding patch, and the feeding patch is loaded with a short-circuit patch to form coupling. The feeding network feeds the feeding unit. The wireless communication device includes a millimeter wave filtering antenna according to the present disclosure. The radiation performance of the antenna can not only realize the filtering characteristics with high roll-off and high isolation, but also ensure that no additional insertion loss is introduced.

16 Claims, 3 Drawing Sheets

MILLIMETER WAVE FILTERING ANTENNA AND WIRELESS COMMUNICATION DEVICE

CROSS REFERENCES TO RELATED APPLICATIONS

This application claims priority to Chinese patent application No. 201910762377.3, filed on Aug. 19, 2019, in the China National Intellectual Property Administration, the disclosure of which is hereby incorporated by reference in its entirety.

TECHNICAL FIELD

The present disclosure relates to the field of radio frequency communication, and specifically to a millimeter wave filtering antenna and a wireless communication device.

BACKGROUND

With the advanced development of wireless communication, the resource of low-frequency spectrum becomes more and more rare. It can be predicted that the millimeter wave will speed up to apply in 5th generation (5G) mobile networks. The millimeter wave refers to an electromagnetic wave with a frequency in the range of 30 GHz-300 GHz, and the corresponding wavelength range is from 1 mm to 10 mm. In recent years, due to the current situation of spectrum resource congestion and the continuous growth of demand for high-speed communication, the millimeter wave field has become an extremely active field of the research, development and utilization of international electromagnetic spectrum resources. A millimeter wave frequency band has a large number of continuous spectrum resources, which provide the possibility for the realization of ultra-high speed broadband wireless communication.

An antenna-in-Package (AIP) technology is to integrate the antenna into a package with a chip through packaging materials and technologies, so as to make the antenna closer to the chip and reduce the interconnection loss. The AIP technology balances performance, cost and volume of the antenna, which represents the great achievement of the antenna technology in recent years.

The antenna is packaged in a transceiver based on RF integrated chip design, but a filter is not suitable to be integrated into the chip, since the Q value is too low. If the filter is packaged separately, interconnections between the filter and the antenna and between the filter and the chip are required, which causes a large loss in the millimeter wave frequency band. In addition, if the suppress is purely realized by a filter and the loss is minimized as much as possible, there is high demand on the Q value of the filter. Therefore, a distributed filtering method is used to integrate the filter and antenna together, which greatly reduces the design difficulty of the filter in a RF chip circuit.

Many filtering methods have been proposed for antenna design, such as cutting slots on a patch/ground plane and placing a parasitic element close to a radiator. In addition, radiation suppression effect can be realized by a resonant unit nested in a microstrip feeding line, use of a fractal tuning short line, use of a small resonant plate, and a quarter wavelength tuning short line nested in a ring monopole.

SUMMARY

In order to overcome the disadvantages and shortcomings of the prior art, a millimeter wave filtering antenna and a wireless communication device are provided by the present disclosure.

The radiation performance of the antenna according to present disclosure can not only realize the filtering characteristics with high roll-off and high isolation, but also ensure that no additional insertion loss is introduced.

The present disclosure includes the following aspects.

According to an aspect of the present disclosure, a millimeter wave filtering antenna is provided, including a parasitic unit, a feeding unit and a feeding network.

The parasitic unit includes at least one quadrilateral parasitic patch and at least one cross shaped parasitic patch, both the at least one quadrilateral parasitic patch and the at least one cross shaped parasitic patch are nested and combined with each other.

The feeding unit includes one feeding patch, and a periphery of the feeding patch is loaded with a short-circuit patch to form coupling.

The feeding network feeds the feeding unit.

In one embodiment, the feeding patch has a local metal metal-to-metal connection with the short-circuit patch.

In one embodiment, the short-circuit patch is provided with a short-circuit post.

In one embodiment, the feeding network is a differential feeding network, and the differential feeding network is formed by two single-polarization differential feeding networks.

In one embodiment, the single-polarization differential feeding network is configured to be fed from a stripline, divided into two ways with a 180 degree phase difference therebetween by a one-to-two power divider, and connected to a feeding via hole to feed the feeding patch.

In one embodiment, when a number of the at least one cross shaped parasitic patch is one, the cross shaped parasitic patch has four quadrants loaded with a quadrilateral parasitic patch respectively.

Alternatively, when a number of the at least one quadrilateral parasitic patch is one and a number of the at least one cross shaped parasitic unit is four, the quadrilateral parasitic patch is surrounded by the cross shaped parasitic patches.

Further, in one embodiment, when the feeding patch is cross shaped, the cross shaped feeding patch has four quadrants loaded with a quadrilateral short circuit patch respectively.

When the feeding patch is quadrilateral, the quadrilateral feeding patch is surrounded by cross shaped short-circuit patches.

In one embodiment, the parasitic unit, the feeding unit and the feeding network are successively arranged from top to bottom according to the present application.

In one embodiment, a length of the cross shaped parasitic patch is an equivalent electrical length of a half wavelength of a zero frequency of radiation introduced by the cross shaped parasitic patch, and a distance between the short-circuit post and a farthest vertex of the short-circuit patch (including square or cross shaped patch) is an equivalent electrical length of a quarter wavelength of a zero frequency of radiation introduced by the short-circuit post.

According to another aspect of the present disclosure, a wireless communication device is provided, including a millimeter wave filtering antenna of the above aspect.

The beneficial effects of the present disclosure are described as follows.

(1) The filtering antenna according to the present disclosure has good radiation performance within a passband, and has filtering effect with high roll-off and good suppression ability outside the passband. The method of realizing the filtering performance neither brings additional processing cost, nor introduces additional insertion loss, while it has wide application range.

(2) The filtering antenna unit has a length from a reference ground of a radiator to a top of the antenna is only 0.074 working wavelength. Therefore, it has the characteristics with low profile, wide band and high gain. Within the passband, the lobe of pattern is stable with good cross polarization.

(3) The whole structure of an antenna array is made by multi-layer PCB processing technology. Therefore it has low cost, compact structure and high reliability, and it is suitable for a high integration RF system.

(4) Since there is no additional filtering circuit, the insertion loss of the filtering antenna according to the present disclosure is very low. Therefore it is more conducive to the low cost and integration of the device compared with the prior filtering antenna design scheme.

DETAILED DESCRIPTION

The present disclosure will be further described in detail with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Embodiment One

Figure 1:
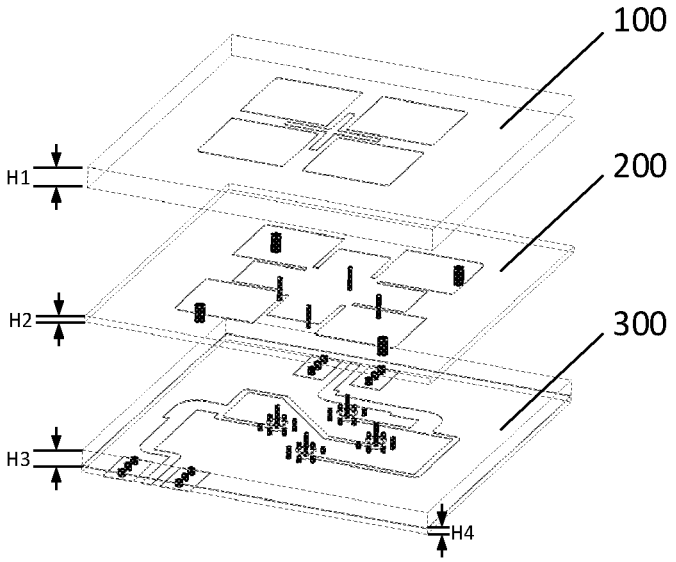
FIG. 1 is a structural schematic diagram illustrating an exploded millimeter wave filtering antenna according to the present disclosure.

Referring to FIG. 1 to FIG. 4, as shown in FIG. 1, a millimeter wave filtering antenna is provided. The whole antenna is formed by bonding a plurality of PCB boards, and includes a parasitic unit 100, a feeding unit 200 and a feeding network 300 successively from top to bottom.

The parasitic unit 100 includes at least one cross shaped parasitic patch 110 and at least one quadrilateral parasitic patch 120 both printed on the PCB board. Both the cross shaped parasitic patch and the quadrilateral parasitic patch are nested and combined with each other.

Figure 2:
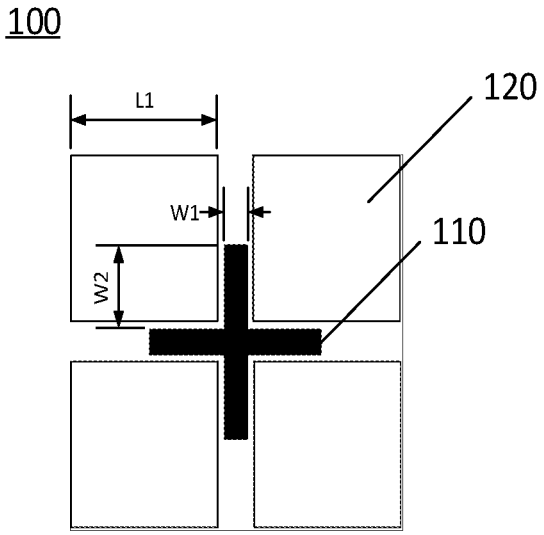
FIG. 2 is a structural schematic diagram illustrating a parasitic unit in FIG. 1.

The number and position of each of the cross shaped parasitic patch and the quadrilateral parasitic patch are determined by the actual situation. In the embodiment, the number of the cross shaped parasitic patch 110 is one, as shown in FIG. 2. The four quadrants of the cross shaped parasitic patch 110 are loaded with a quadrilateral parasitic patch 120 respectively, and the center point of the cross shaped parasitic unit 110 is located at the center of the PCB board.

Alternatively, the number of the quadrilateral parasitic patch is one, cross shaped parasitic patches are arranged at the four corner directions of the quadrilateral parasitic patch. Alternatively, four quadrilateral parasitic patches and four cross shaped parasitic patches are arranged in combination. The number of the parasitic patches and the cross shaped parasitic patches in the parasitic unit is not fixed. It is a planar structure composed of the same parasitic patches or cross shaped units arranged periodically in two dimensions. In this embodiment, the quadrilateral parasitic patches are square.

The cross shaped parasitic patch 110 is loaded above the feeding patch 210 and coupling is formed by the cross shaped parasitic patch 110 and the feeding patch 210. A zero point is introduced to a right side of the working passband. In addition, another zero point can be introduced by loading a parasitic patch 110 around the cross shaped parasitic unit 100. The two zero points work together to achieve rapid roll-off for a high-frequency edge and out-of-band suppression effect.

The feeding unit 200 includes a cross shaped feeding patch 210 and a short-circuit patch 220 which are printed on the PCB board. The feeding patch may also has a square structure, and the short-circuit patch may have a quadrilateral or a cross shaped structure. In this embodiment, the short-circuit patch 220 has a square structure. The coupling is formed by loading the short-circuit patch 220 on the cross shaped feeding patch 210. A suppression zero point of radiation is introduced to the left side of the working passband by the resonance effect of the short-circuit patch 220, therefore the high pass filtering response of antenna radiation is realized. Furthermore, the cross shaped feeding patch 210 is connected to part of the four short-circuit patches 220 around the cross shaped feeding patch 210, so that additional inductance component is introduced. Therefore, the filtering effect at low frequency is further improved, which has good low-frequency suppression in a wider range.

Figure 3:
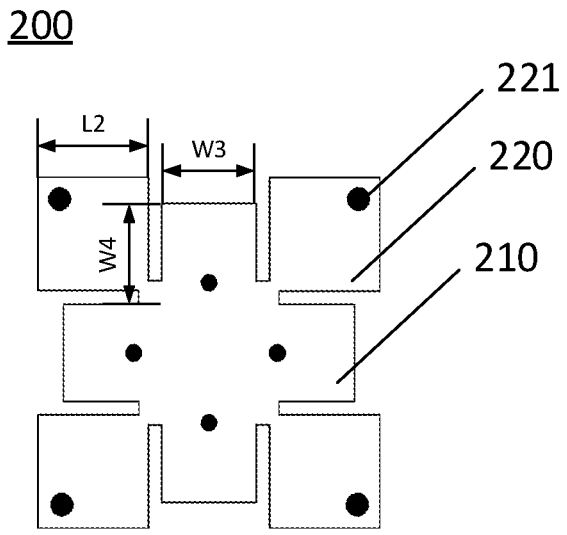
FIG. 3 is a structural schematic diagram illustrating a feeding unit in FIG. 1.
Figure 4:
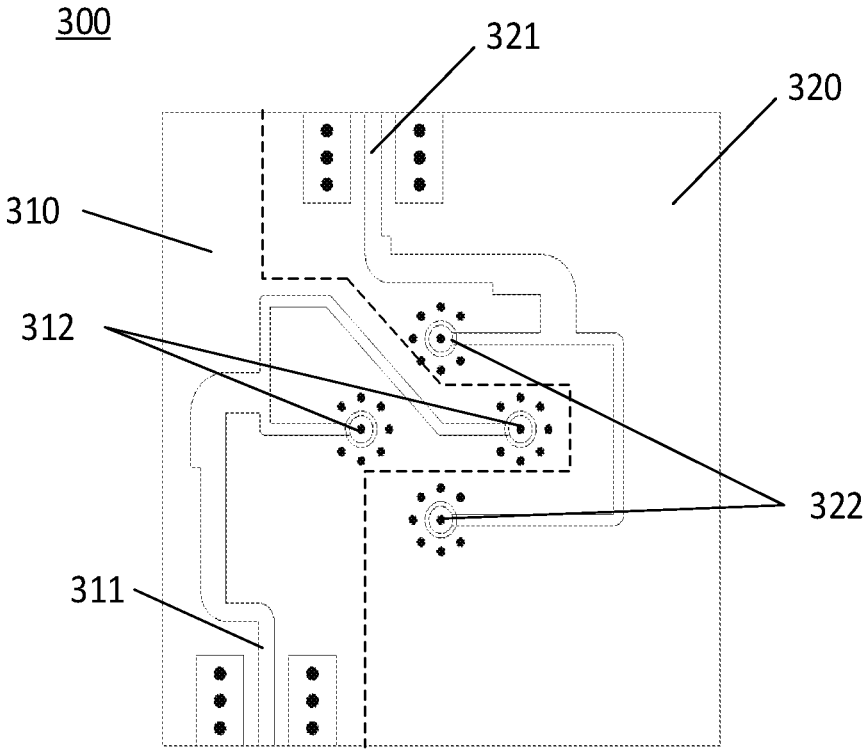
FIG. 4 is a structural schematic diagram illustrating a differential feeding network in FIG. 2.

In the feeding unit 200, the number of each of the cross shaped feeding patch 210 and the quadrilateral short circuit patch 220 are determined according to the actual situation. In the embodiment, when the number of the cross shaped feeding patch 210 is one, the four quadrants of the cross shaped feeding patch 210 is loaded with a quadrilateral short-circuit patch 220 respectively, as shown in FIG. 3.

When the feeding patch is square, the cross short-circuit patches are loaded around the feeding patch.

The short-circuit patch 220 is provided with a short-circuit post 221. A length of the cross shaped parasitic patch 110 is an equivalent electrical length of a half wavelength of a zero frequency of radiation introduced by the cross shaped parasitic patch 110, and a distance between the short-circuit post 221 and a farthest vertex of the short-circuit patch 220 is an equivalent electrical length of a quarter wavelength of a zero frequency of radiation introduced by the short-circuit post 221.

In this embodiment, the frequency for generating filtering is only related to the size of the patch or the cross shaped unit.

The feeding network 300 is printed on the PCB board, specifically as a dual polarization differential feeding network formed by two single-polarization differential feeding networks 310, 320. Energy is fed by a stripline 311, 321 between two layers of ground. The dual polarization effect is realized by differential feeding to the upper layer feeding patch 210 by two pairs of feeding via holes 312,322.

In this embodiment, three PCB boards are arranged in parallel with each other, and their center points are on a vertical straight line.

In this embodiment, the working frequency band is 24.2-29.5 GHz, and corresponding dimensions of the millimeter wave filtering antenna are shown in FIG. 1-FIG. 4. The specific parameters are as follows:

L1=1.6 mm, L2=1.6 mm, H1=0.406 mm, H2=0.12 mm, H3=0.305 mm, H4=0.102 mm, W1=0.15 mm, W2=0.875 mm, W3=1.06 mm, and W4=1.22 mm.

Figure 5:
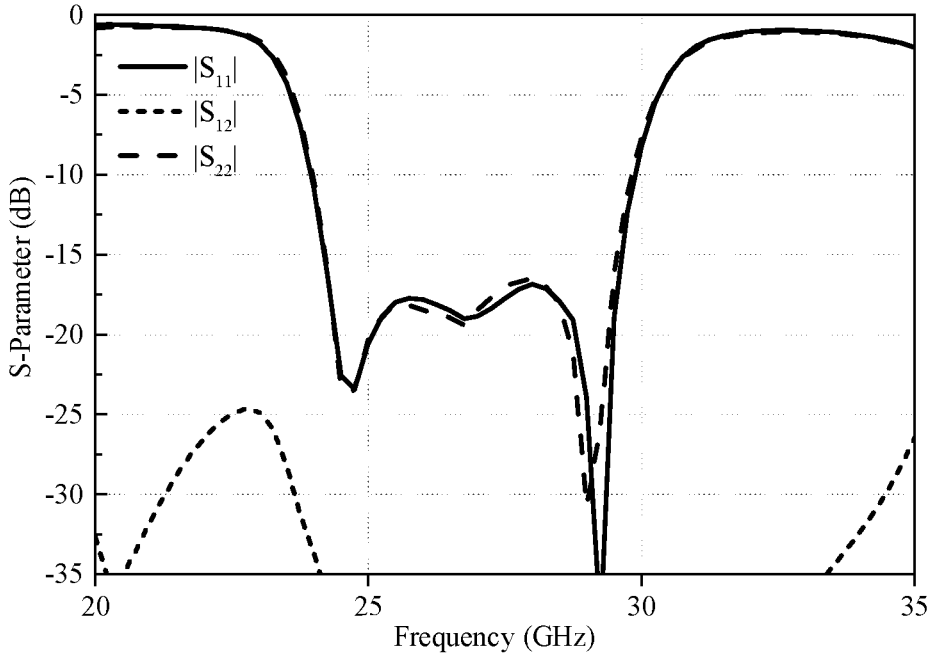
FIG. 5 is a simulation result diagram of a return loss and polarization isolation curve of the millimeter wave filtering antenna according to the present disclosure.

As shown in FIG. 5, it shows a diagram of a S-parameter of the millimeter wave filtering antenna according to one embodiment of the present disclosure. The impedance is well matched within the passband, all the return losses are above 15 dB, and the polarization isolation in the working frequency band is maintained above 35 dB.

Figure 6:
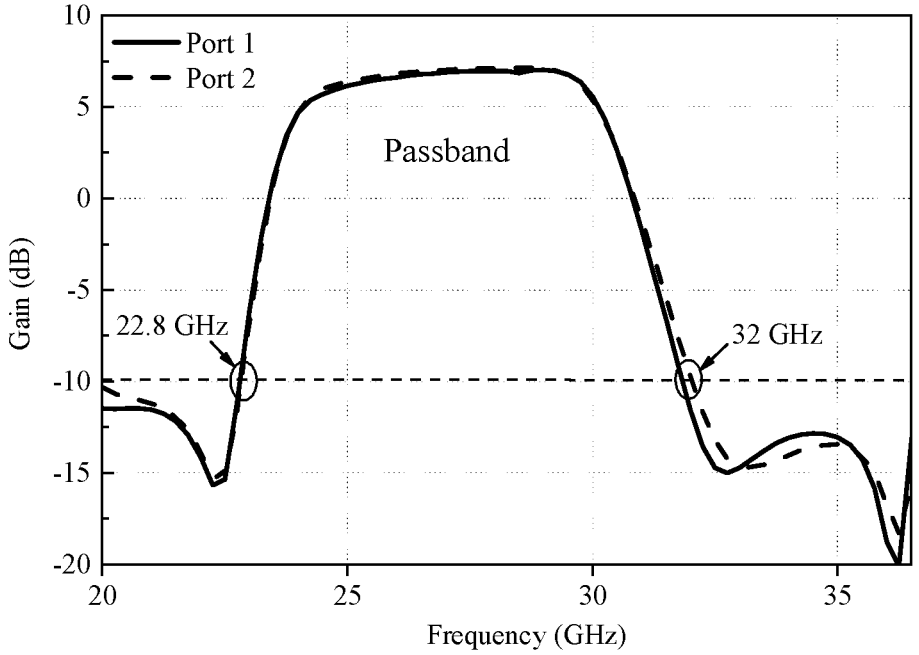
FIG. 6 is a simulation result diagram of a gain curve of the millimeter wave filtering antenna according to an embodiment of the present disclosure.

As shown in FIG. 6, it shows a diagram of a gain curve of the millimeter wave filtering antenna according to one embodiment of the present disclosure. The gain is stable within the working frequency range of 24.20-29.56 GHz, and a 22% relative bandwidth is reached. Both sides of the passband have filtering characteristics with high roll-off From 0-22.5 GHz, a filtering suppression more than 17 dB is achieved and from 32.4-36 GHz, and an out-of-band filtering suppression more than 19.4 dB is achieved.

The filtering method adopted is mainly realized by nesting two kinds of parasitic structures in the antenna radiator structure. These two kinds of parasitic structures include a cross shaped parasitic unit loaded with parasitic patches and a short-circuit patch structure. These two filtering structures introduce a zero point to the left side of the working passband and two zero points to the right side of the working passband respectively through coupling effect, so that the fast roll-off for the high-frequency edge and out-of-band suppression effect are achieved by the combined action.

Embodiment Two

A wireless communication device includes a millimeter wave filtering antenna according to the present disclosure.

The above-mentioned embodiments are preferred embodiments of the invention, but the embodiment of the invention is not limited by these embodiments. Any other changes, modifications, substitutions, combinations and simplifications made without departing from the spiritual essence and principle of the invention shall be equivalent replacement methods and shall be included in the protection scope of the invention.

What is claimed is:

1. A millimeter wave filtering antenna, comprising:

a parasitic unit including a first printed circuit board, wherein one cross shaped parasitic patch having four first quadrants is arranged on the first printed circuit board, and wherein four square shaped parasitic patches are arranged on the first printed circuit board and are positioned in the four first quadrants, respectively;

a feeding unit including a second printed circuit board, wherein one cross shaped feeding patch having four second quadrants is arranged on the second printed circuit board, wherein four short-circuit patches are arranged on the second printed circuit board and are positioned in the four second quadrants, respectively, and wherein each of the four short-circuit patches is coupled to the cross shaped feeding patch; and a feeding network arranged on a third printed circuit board, wherein the feeding network is configured to feed the feeding unit, wherein the cross shaped parasitic patch is positioned adjacent to the cross shaped feeding patch, and wherein the cross shaped parasitic path is coupled to the cross shaped feeding patch.

2. The millimeter wave filtering antenna according to claim 1, wherein the feeding patch has a local metal-to-metal connection with each of the four short-circuit patches.

3. The millimeter wave filtering antenna according to claim 1, wherein each of the four short-circuit patches is provided with a short-circuit post.

4. The millimeter wave filtering antenna according to claim 3, wherein a length of the cross shaped parasitic patch is an equivalent electrical length of a half wavelength of a zero frequency of radiation introduced by the cross shaped parasitic patch, and a distance between the respective short-circuit post and a farthest vertex of the short-circuit patch is an equivalent electrical length of a quarter wavelength of a zero frequency of radiation introduced by the respective short-circuit post.

5. The millimeter wave filtering antenna according to claim 1, wherein the parasitic unit, the feeding unit and the feeding network are successively arranged from top to bottom.

6. The millimeter wave filtering antenna according to claim 1, wherein the feeding network is a differential feeding network formed by two single-polarization differential feeding networks.

7. The millimeter wave filtering antenna according to claim 6, wherein the single-polarization differential feeding network is configured to be fed from a stripline, divided into two ways with a 180 degree phase difference there between by a one-to-two power divider, and connected to a feeding via hole to feed the feeding patch.

8. A wireless communication device, comprising the millimeter wave filtering antenna according to claim 1.

9. The millimeter wave filtering antenna according to claim 1, wherein the first, second, and third printed circuit boards are bonded together.

10. The millimeter wave filtering antenna according to claim 1, wherein the first, second, and third printed circuit boards are arranged in parallel with each other.

11. The millimeter wave filtering antenna according to claim 1, wherein the first, second, and third printed circuit boards each have a respective center point, and wherein each of the center points of the first, second, and third printed circuit boards are positioned on a straight line.

12. The millimeter wave filtering antenna according to claim 11, wherein the straight line is a vertical straight line.

13. The millimeter wave filtering antenna according to claim 1, wherein the millimeter wave filtering antenna is configured to introduce a working passband.

14. The millimeter wave filtering antenna according to claim 13, wherein the working passband introduces at least a zero point to a right, higher-frequency, side of the working passband.

15. The millimeter wave filtering antenna according to claim 13, wherein the working passband introduces at least a zero point to a left, lower-frequency, side of the working passband.

16. The millimeter wave filtering antenna according to claim 1, wherein the cross shaped parasitic patch is positioned above the cross shaped feeding patch.

* * * * *